United States Patent [19]

Steiner

[11] Patent Number: 4,735,322

[45] Date of Patent: Apr. 5, 1988

[54] CLOTHES DRYING APPARATUS

[76] Inventor: Walter Steiner, Saentisstrasse 52, CH-8311 Bruetten, Switzerland

[21] Appl. No.: 919,528

[22] Filed: Oct. 16, 1986

[30] Foreign Application Priority Data

Oct. 24, 1985 [DE] Fed. Rep. of Germany ..... 3537887

[51] Int. Cl.[4] ..... D06F 53/00

[52] U.S. Cl. ..... 211/119.01; 211/196; 211/197

[58] Field of Search ..... 211/119.03, 119.01, 211/196, 197, 119.15

[56] References Cited

U.S. PATENT DOCUMENTS 176,326 4/1876 Lovejoy ..... 211/187

FOREIGN PATENT DOCUMENTS

Nr 312548 1/1974 Austria ..... 8/
0113788 1/1983 European Pat. Off. ..... 3/
0113789 1/1983 European Pat. Off. ..... 3/
0134826 8/1983 European Pat. Off. ..... 4/
2205472 8/1973 Fed. Rep. of Germany ..... 211/119.01
2855532 7/1980 Fed. Rep. of Germany ..... 211/119.01
3249358 4/1984 Fed. Rep. of Germany ..... 3/
614521 12/1960 Italy ..... 211/197
893033 4/1962 United Kingdom ..... 211/197

*Primary Examiner*—Ramon S. Britts
*Assistant Examiner*—Blair Johnson
*Attorney, Agent, or Firm*—Reed Smith Shaw & McClay

[57] ABSTRACT

A clothes drying apparatus is provided which has a plurality of support arms pivotally mounted on a central supporting post, which may be spread out from a folded position to an operating position. The clothes are hung on clothes line portions extending between the support arms arranged around the central supporting post. For spreading apart the support arms into the operative position, an operating cord is provided, one end thereof being attached to a head member mounted on the top of the post, and which is guided around two deflecting members. The first deflecting member is mounted on a collar member displacably mounted on the central post, and the other one is mounted on one of the support arms. Thereby a radial force component is built up upon unfolding the apparatus which greatly facilitates the spreading out of the supporting arms since only a small pulling force has to be exerted on the free end of the operating cord.

10 Claims, 2 Drawing Sheets

CLOTHES DRYING APPARATUS

BACKGROUND OF THE INVENTION

The present invention relates to a clothes drying apparatus which comprises a central, elongate supporting post member, a collar member surrounding the supporting post member which includes a plurality of radially protruding webs, this collar member being axially displaceably mounted on the supporting post member. The apparatus further comprises a plurality of support arms, one end thereof being pivotally mounted via a first joint on the radially protruding webs, and a clothes line constituting a plurality of clothes line portions which extend between the support arms.

The central supporting post member comprises a head member mounted at the top of the supporting post member, and a plurality of strut members, one end thereof being pivotally connected to the head member and the other end thereof being pivotally connected via a second joint to one of the support arms.

Operating means are provided to spread the support arms from a rest position in which the arms are in an essentially parallel position to the central supporting post member, into an extended position in which the clothes line portions extending between the support arms are in an essentially tensioned condition by displacing the collar member from a lower rest position towards said head member.

PRIOR ART

A clothes drying apparatus of this or a similar kind is known e.g. from German Pat. No. 32 49 358 or from European Pats. Nos. 0 113 788, 0 113 789 and 0 134 826. A cord is thereby used to spread the support arms from a folded rest position into an unfolded operating position, the cord being arranged in a pulley block-like manner between the upper end portion of the supporting post member and the displaceable collar member. Upon pulling the cord, the collar member is discplaced upwardly and the support arms which are pivotally connected to the collar member are spread outwardly in order to tension the clothes line portions extending between the support arms.

The Austrian Pat. No. 312 548 discloses a similar clothes drying apparatus having operating means to spread the support arms outwardly. The operation of spreading out the arms should be facilitated by the provision of a first cord pulley mounted on the upper end of the supporting post member, a second cord pulley mounted on the displaceable collar and, if appropriate, a third pulley mounted on the support arm. The one end of the cord is thereby connected to the upper end of the supporting post member, led to the second pulley mounted on the displaceable collar to be deviated by 180°, led back to the first pulley mounted on the upper end of the supporting post member to be further deviated by at least 90° and, if appropriate, led to the third pulley mounted on the support arm to be deviated downwardly. Again, a principle of a pulley block is used to decrease the operating forces, with the expense of an increased operating way of the cord.

However, in the folded together inoperative or initial position of the clothes drying apparatus of this kind, the usually four arms together with the struts articulated to each of them form in each case an elongated spreading leg pair, on whose ends the tension of the operating cord acts parallel to the supporting post member as soon as the support arms are to be spread apart. This means that at the beginning of the spreading operation for the support arms, due to their almost parallel orientation with respect to the supporting post member, a disproportionately high pulling force is required on the operation cord in order to overcome the almost flat or (depending on the consideration mode) very acute angle between the support arm and the strut member. It is very difficult, if not impossible, without manual support, to provide an adequate radial force component for spreading apart of the support arms over the very acute angle between support arm and the pulling direction of the operation cord running parallel to the supporting post member. It is admitted that the already known arrangements might provide a substantial decrease in pulling force to be expensed, but they can not provide the radial force component required to facilitate the initial tilting motion of the support arms to overcome the unfavourable angle, which radial force would substantially facilitate the spreading apart of the apparatus and, further, would render a pulley block function superfluous.

OBJECTS OF THE INVENTION

It is a primary object of the present invention to improve an clothes drying apparatus of the prior art as hereinbefore discussed so that the aforementioned disadvantages no longer occur.

It is a further object of the invention to provide a clothes drying apparatus in which the cord means is guided such that the apparatus may easily be brought from a folded rest position into an unfolded operating position wherein the support arms may be spread out with low effort.

A still further object of the invention is to provide an apparatus in which a radial force exerted to at least one support arm upon operating the cord means in order to bring the folded support arms which lie essentially parallel to the central support post out of a disadvantageous dead centre position into a more favourable kinematic position.

SUMMARY OF THE INVENTION

The invention provides a clothes drying apparatus which comprises a central, elongated supporting post member with a collar member surrounding the supporting post member which collar includes a plurality of radially protruding webs. The collar member is axially displaceably mounted on the supporting post member.

The apparatus further comprises a plurality of support arms, one end thereof being pivotally mounted via a first joint on the radially protruding webs, and a clothes line comprising a plurality of clothes line portions extending between said support arms.

The supporting post member includes a head member mounted on the top of the supporting post member, and a plurality of strut members is provided, one end thereof being pivotally connected to the head member and the other end thereof being pivotally connected via a second joint to one of the support arms.

In order to spread the support arms from a rest position in which the arms are in an essentially parallel position with regard to the central support member into an extended position in which the clothes line portions extending between the support arms are in an essentially tensioned condition, operating means are provided which displace the collar member from a lower rest position towards the head member. The operating means includes cord means, one end thereof being fixedly connected to the head member, first deflecting members mounted on the collar member in order to deviate the cord means in a first direction, and second deflecting members mounted on one of the support arms in order to deviate the cord means is a second direction opposite to said first direction.

The cord means is guided from the head member directly to the first deflecting member and therefrom directly to the second deflecting member. The cord means further comprises a free end portion protruding from the support arm incorporating the second deflecting member for operating the clothes drying apparatus by pulling this free end radially outwardly.

Advantageously the second deflecting member is a pulley rotatably mounted on a pin which simultaneously is part of the first joint between the support arm and the associated strut member, and the first deflecting member is a pulley rotatably mounted on a pin which simultaneously is part of the second joint between the support arm and the collar member.

BRIEF DESCRIPTION OF THE DRAWING

In the following, an embodiment of the invention will be further described, with reference to the enclosed drawing, in which an upper part of the apparatus is schematically shown. Particularly, only the upper portion of the supporting post, one of the support arms (in part) and the associated strut together with the cord means is shown.

DESCRIPTION OF A PREFERRED EMBODIMENT

Figure 1:
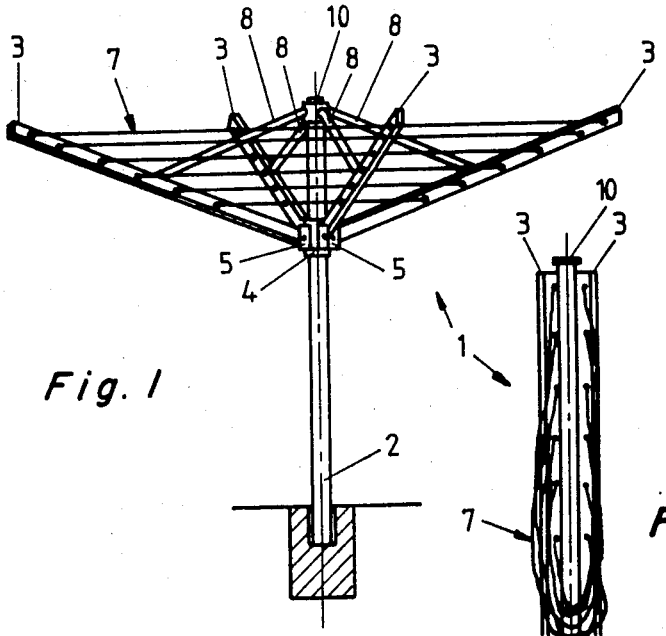
Figure 3:
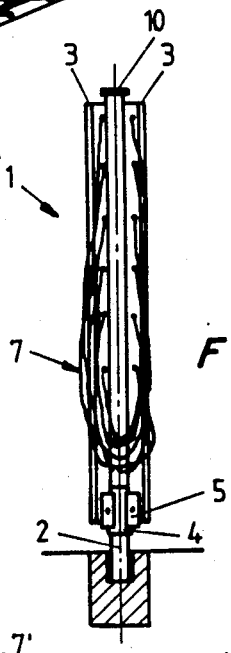
Figure 2:
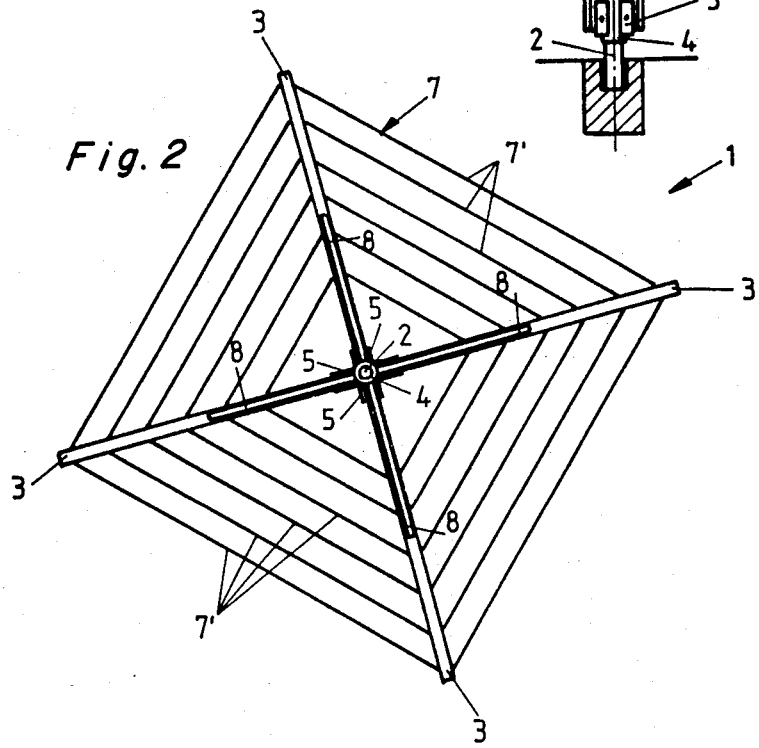
Figure 4:
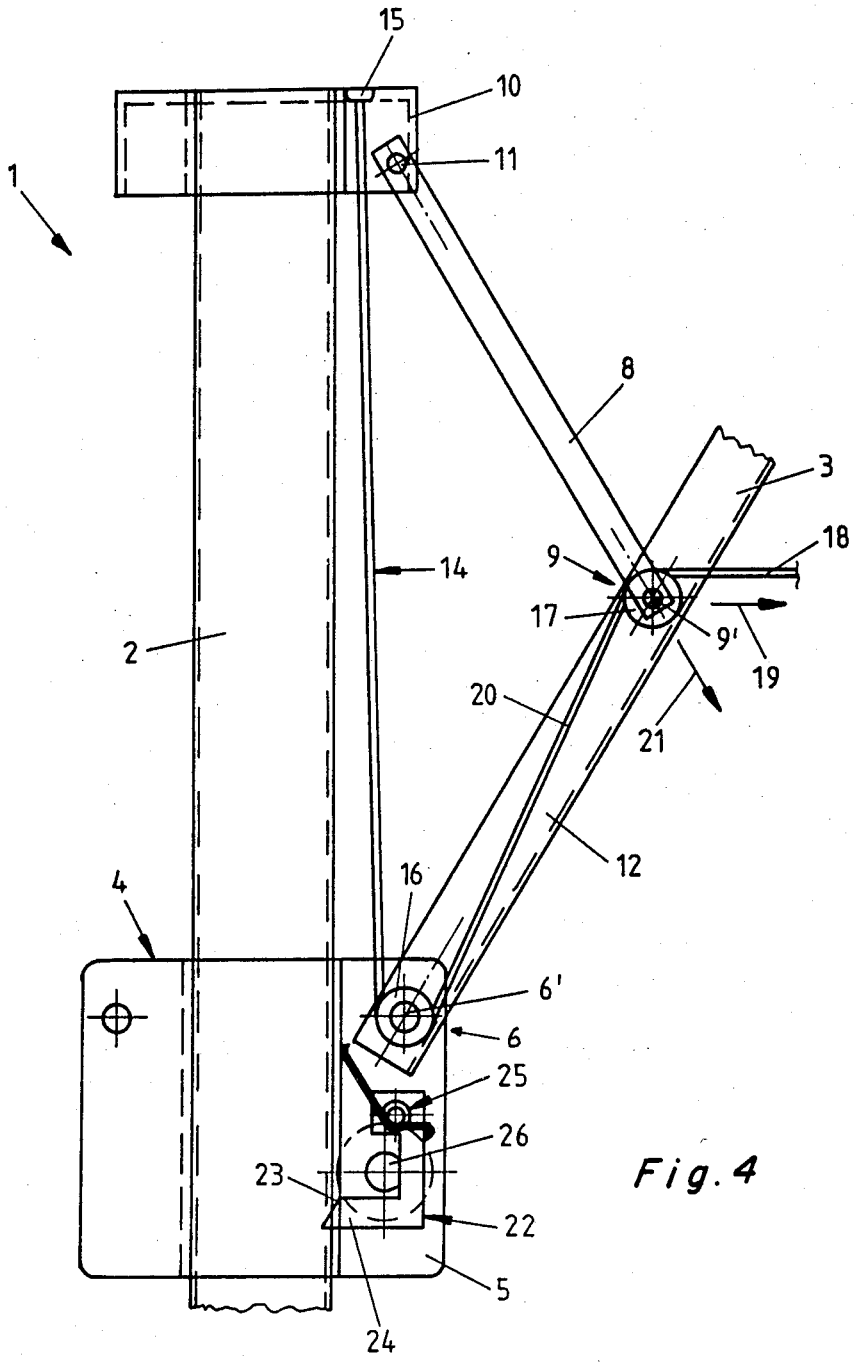

The general design of such an umbrella-like or spider's web-type clothes drying apparatus is adequately known from constructions thereof available in numerous households, as well as from the aforementioned publications, removing the need to give further detailed explanations or to present additional drawings.

The clothes drying apparatus as shown in the attached drawing comprises a plurality, e.g. four support arms 3 which are arranged in equidistant relationship around a central, vertical supporting post 2. The support arms 3 together serve a support for a (not shown) clothes line whose portions extend between the individual support arms 3 when said arms 3 are in their spread out position (i.e. in the operative position of the clothes drying apparatus).

The central post 2 comprises a slidably mounted collar surrounding the post 2 and having four radially protruding webs 5. The lower ends of the four support arms 3 are pivotally mounted on the webs 5 by means of pins 6'. Struts 8 are provided, one strut 8 being associated to each one supporting arm 3, one end thereof being pivotally mounted on the support arm 3 in a predetermined distance from the linkage 6 by means of a bolt 9' and the other end thereof, i.e. the end remote from the support arm 3, is pivotally mounted on a head member 10 arranged on the top of the central post 2 by means of a pin 11. The arrangement shown in the attached drawing is such that the length of a portion 12, i.e. the lever arm portion of the support arm 3, extending between the lower end of the arm 3 and the connection point of the strut 8, has substantially the same length as the associated strut 8.

When the clothes drying apparatus 1 is not in use, the support arms 3 are pivoted against the central post 2 and consequently also the struts 8. The spreading leg pair 12, 8 formed by each arm portion 12 and associated strut 8 is thereby fully or almost fully extended and the collar 4 is in its lowermost position.

For spreading apart the support arms 3, i.e. for putting the clothes drying apparatus 1 into operation, an operating cord 14 is provided, one end 15 thereof being connected to the head member 10 of the post 2, the cord 14 being passed around the pins 6' and 9' of one of the four support arms 3. Advantageously the pins 6' and 9' receive roller means 16 and 17 rotatably mounted thereon which serve to guide the operating cord 14 and help to reduce friction.

The (not shown) free end of the operating cord 14 is located on the leading side of the roller 17 and a small portion thereof hangs outwards so that it can be gripped by the hand of an operator. The position of this free end of the cord is thereby in a comfortable height of approximately 0.8 to 1.2 meters so that it is easily possible to grasp and operate the operating cord without any effort and without bending in a comfortable and ergonomic manner.

By pulling on this free end 18 of the operating cord 14 in a direction away from the central post 2, in the direction of arrow 19, the collar member 4 displaceably mounted on the central post 2 is drawn upwards with the consequence that the arm portion 3 and the strut 8, i.e. the spreading leg pair constituted by these two elements, are folded together in a scissorlike manner. Thus the supporting arm 3 is forced to spread outwards until a position is reached in which all support arms 3 are spread so far outwards that the clothes line portions running between the arms 3 are adequately stretched to enable articles of clothing to be hung thereon.

Due to the fact that the operating cord 14 runs around the pin 9' provided on the support arm 3 and the roller 17 rotatably mounted thereon, respectively, a pronounced torque results in response to the pulling force of the operating cord 14 on the support arm 3 so that the clothes drying apparatus 1 and the associated support arms 3, respectively, may be spread out with a correspondingly low effort. This torque results from the effects of a lever arm whose length corresponds to the support arm portion 12 and a component of the force exerted on the operating cord 14 in the direction of arrow 21, the direction thereof dividing the angle between the cord positions 18 and 20 by two. As a result, at the start of spreading apart the support arms 3, there is an important force component greatly facilitating the unfolding of the clothes drying apparatus 1 in the form of a torque on the support arms 3 about the pivot pin 6'. In addition, the unfolding of the apparatus 1, i.e. the spreading apart of the support arms 3, is assisted by a force component of the operating cord 14 acting on pin 6' in a direction parallel to the central post 2 which attempts to displace the collar 4 upwards.

A latch 22 provided on the support collar 4 slides with its end 24 having a bevel 23 over locking openings arranged in a row on the central post member 2 when the collar 4 is displaced upwards. A spring 25 presses the latch end 24 against the central post 2 and the row of locking openings, respectively, in order to provide a locked positioning of the collar 4 in one of said openings, thereby preventing an undesired downward movement of the collar 4 when the support arms 3 have reached their spread out position of operation. The release of the latching effect, in order to bring the clothes drying apparatus in its inoperative position, i.e.

with the support arms 3 folded together, is done by means of a cam 26 which is operated by a (not shown) handle which cam engages, with its circumference, the latch 22.

In contrary to the embodiment shown in the attached drawing, the desired effect may also be obtained if the deviation point of the operating cord 14 provided on the support arm 3 is at a different position. However, it is important that there is an adequate or sufficient distance between the deviation point and the collar 4 in order to provide a substantial lever effect at the support arm 3. This distance preferably corresponds to at least the distance between collar 4 and linkage point 9 which is situated between the support arm 3 and the strut 8. This measure also ensures that the free end of the operating cord, when the clothes drying apparatus is in its operative position, does not extend down to the ground and, consequently, is not exposed to contamination.

What I claim is:

1. A clothes drying apparatus comprising a central, elongate supporting post member;

a collar member surrounding said supporting post member and including a plurality of radially protruding webs, the collar member being axially displaceably mounted on said supporting post member;

a plurality of support arms, one end thereof being pivotally mounted via a first joint on said radially protruding webs, and a clothes line comprising a plurality of clothes line portions extending between said support arms;

a head member mounted at the top of said supporting post member, a plurality of strut members, one end thereof being pivotally connected to said head member and the other end thereof being pivotally connected via a second joint to one of said support arms;

operating means adapted to spread said support arms from a rest position in which the arms are in essentially parallel position with regard to the central supporting post member into an extended position in which the clothes line portions extending between the support arms are in an essentially tensioned condition by displacing said collar member from a lower rest position towards said head member;

said operating means including cord means comprising a flexible cord, one end thereof being fixedly connected to said head member, a first deflecting member mounted on said collar member and engaging said cord means, thereby deviating said cord means in a first direction, and a second deflecting member mounted on one of said support arms and also engaging said cord means, thereby deviating said cord means in a second direction, said second direction being substantially away from said support post member, whereby said cord means is guided from said head member directly to said first deflecting member and therefrom directly to said second deflecting member, said cord means further comprising a free end portion protruding from said second deflecting member for operating the clothes drying apparatus by pulling said free end radially outwardly.

2. A clothes drying apparatus according to claim 1, in which the distance of the position of said second deflecting member on said support arm from the connecting position of said support arm to said collar member is such that a lever arm is formed.

3. A clothes drying apparatus according to claim 2, in which the distance of the position of said second deflecting member on said support arm from the connecting position of said support arm to said collar member corresponds at least to the distance between said first joint of said strut member to said support arm and the connecting position of said support arm to said collar member.

4. A clothes drying apparatus according to claim 1 or 3, in which said second deflecting member is a pulley rotatably mounted on a pin which simultaneously is part of said first joint between said support arm and said strut member.

5. A clothes drying apparatus according to claim 1, in which said first deflecting member is a pulley rotatably mounted on a pin which simultaneously is part of said second joint between said support arm and said collar member.

6. A clothes drying apparatus comprising:

(a) a central, elongate supporting post member;

(b) a collar member surrounding said supporting post member and including at least one radially protruding support arm, the collar member being axially displaced on said supporting post member;

(c) a head member mounted on top of said supporting post member;

(d) a strut, having one end pivotally connected to said head member and the other end thereof being pivotally connected via a second joint to said support arm;

(e) said collar being movable from a lower rest position to a position closer to said head to a spread position;

(f) said strut cooperating with said support arm and said collar for movement between a rest position wherein said strut is essentially colinear with said support arm and parallel to said post member and a spread position wherein said support arm extends radially from said post member and at an angle to said strut;

(g) a cord having an end fixed to said head member, a first deflecting member mounted on said collar member and configured to direct said cord in a first direction and a second deflecting member mounted at the juncture of said support arm and strut and being configured to deviate said cord in a second direction different from said first direction, said cord being guided from said head member directly to said first deflecting member and therefrom directly to said second deflecting member, said cord having a free end protruding from the juncture of said support arm and strut and incorporating said second deflecting member for operating the clothes drying apparatus by pulling said free end radially outwardly; and (h) said cord coordinating with said second deflecting member to impose a radial force on said strut and support arm and simultaneously impart an upward force on said collar to move said strut and support arm to said spread position from said rest position.

7. The apparatus according to claim 6 wherein said other end of said strut is pivotally attached to a strut pin on said support arm and said second deflecting member including a pulley also rotatably mounted about said strut pin.

8. The apparatus according to claim 7 wherein said support arm is pivoted about a collar pin on said collar and said first deflecting member includes a first pulley also rotatably mounted about said collar pin.

9. The apparatus according to claim 8 further comprising a latch for locking said support collar in a fixed position relative to said post.

10. The apparatus according to claim 9 wherein said latch includes an end portion with a bevel, locking openings in said post; a spring for biasing said latch into said openings and for locking said collar against downward movement while permitting upward movement.

* * * * *